US012338724B2

(12) United States Patent
Neufeldt et al.

(10) Patent No.: US 12,338,724 B2
(45) **Date of Patent: *Jun. 24, 2025**

(54) METHODS, SYSTEMS, AND MEDIA FOR CONTROLLING A TOOLFACE OF A DOWNHOLE TOOL

(71) Applicant: PASON SYSTEMS CORP., Calgary (CA)

(72) Inventors: Adam Chase Neufeldt, Calgary (CA); Brian James Eley, Calgary (CA); Thomas William Charles Wilson, Calgary (CA); Trevor Leigh Holt, Calgary (CA)

(73) Assignee: PASON SYSTEMS CORP., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/241,643

(22) Filed: Sep. 1, 2023

(65) Prior Publication Data

US 2023/0417134 A1 Dec. 28, 2023

Related U.S. Application Data

(60) Continuation of application No. 17/875,066, filed on Jul. 27, 2022, now Pat. No. 11,802,473, which is a (Continued)

(51) Int. Cl.
*E21B 44/06* (2006.01)
*E21B 3/02* (2006.01)
(Continued)

(52) U.S. Cl.
CPC ..... *E21B 44/06* (2013.01); *E21B 3/02* (2013.01); *E21B 7/04* (2013.01); *E21B 21/08* (2013.01); *E21B 47/024* (2013.01)

(58) Field of Classification Search
CPC ... E21B 44/06; E21B 3/02; E21B 7/04; E21B 21/08; E21B 47/024
See application file for complete search history.

(56) References Cited

U.S. PATENT DOCUMENTS 6,050,348 A 4/2000 Richardson et al.
6,918,453 B2 7/2005 Haci et al.
(Continued)

FOREIGN PATENT DOCUMENTS

CA 2525382 11/2004
CA 2525371 12/2004
(Continued)

OTHER PUBLICATIONS

SPE 167141—Practical Directional Drilling Techniques in Pinedale Field Wyoming to Improve Drilling Performance, Guangzhi Han, Lane Lemesany, Azar A. Azizov, Frank DeLeon, all Baker Hughes.
(Continued)

*Primary Examiner* — Dany E Akakpo
(74) *Attorney, Agent, or Firm* — Katten Muchin; ROSENMAN LLP

(57) ABSTRACT

Methods, systems, and computer-readable media for controlling a toolface of a downhole tool are described. The toolface of the downhole tool, and a toolface setpoint, are determined. Based on the toolface and the toolface setpoint, a toolface error is determined. Based on the toolface error, one or more drilling parameter setpoints are selected from among multiple drilling parameter setpoints. The selected one or more drilling parameter setpoints are adjusted. The adjusted one or more drilling parameter setpoints are inputted to one or more drilling controllers for controlling the toolface of the downhole tool.

14 Claims, 10 Drawing Sheets

Related U.S. Application Data division of application No. 16/600,210, filed on Oct. 11, 2019, now Pat. No. 11,549,357.

(51) Int. Cl.

| | |
|---|---|
| ***E21B 7/04*** | (2006.01) |
| ***E21B 21/08*** | (2006.01) |
| ***E21B 47/024*** | (2006.01) |

(56) References Cited

U.S. PATENT DOCUMENTS

| | | | |
|---|---|---|---|
| 7,096,979 | B2 | 8/2006 | Haci et al. |
| 7,139,689 | B2 | 11/2006 | Huang |
| 7,152,696 | B2 | 12/2006 | Jones |
| 7,588,099 | B2 | 9/2009 | Kracik |
| 7,823,655 | B2 | 11/2010 | Boone et al. |
| 10,036,678 | B2 | 7/2018 | Fisher et al. |
| 10,190,402 | B2 | 1/2019 | Dykstra et al. |
| 10,214,964 | B2 | 2/2019 | Hornblower et al. |
| 10,358,904 | B2 | 7/2019 | Kyllingstad |
| 10,533,409 | B2 | 1/2020 | Benson et al. |
| 10,612,307 | B2 | 4/2020 | Summers et al. |
| 10,731,453 | B2 | 8/2020 | Groover et al. |
| 10,830,033 | B2 | 11/2020 | Weideman et al. |
| 10,883,356 | B2 | 1/2021 | Jeffryes et al. |
| 10,954,773 | B2 | 3/2021 | Benson et al. |
| 11,143,011 | B2 | 10/2021 | Boone et al. |
| 11,421,520 | B2 | 8/2022 | Zaripov |
| 2002/0104685 | A1 | 8/2002 | Pinckard et al. |
| 2019/0330968 | A1* | 10/2019 | Boone ..... E21B 7/04 |

FOREIGN PATENT DOCUMENTS

| | | |
|---|---|---|
| CA | 2582365 | 4/2006 |
| CA | 2636249 | 8/2007 |
| CA | 2700258 | 3/2009 |
| CA | 2921163 | 4/2015 |
| CA | 2938521 | 9/2015 |

OTHER PUBLICATIONS

Well Engineers Notebook, Feb. 1998, 4th Edition, May 2003, Shell International Exploration and Production B.V., EP Learning and Development.

* cited by examiner

METHODS, SYSTEMS, AND MEDIA FOR CONTROLLING A TOOLFACE OF A DOWNHOLE TOOL

CROSS REFERENCE TO RELATED APPLICATIONS

This application is a continuation application of U.S. patent application Ser. No. 17/875,066 filed on Jul. 27, 2022, which is a divisional application of U.S. patent application Ser. No. 16/600,210 filed on Oct. 11, 2019, which are hereby incorporated herein by reference in their entirety.

TECHNICAL FIELD

The present disclosure relates to methods, systems, and computer-readable media for controlling a toolface of a downhole tool.

BACKGROUND

During oil and gas drilling, a drill bit located at the end of a drill string is rotated into and through a formation to drill a wellbore. One form of drilling is directional drilling, in which the drill string has a slight bend near its distal end. During directional drilling, it is common practice to alternate between sliding and rotating. When sliding, the drill string is rotated to a particular orientation, and then drilling proceeds with the drill string maintained in this constant orientation, allowing the driller to alter the direction of the wellbore via the bend in the drill string. When rotating, the entire drill string is rotated, allowing the driller to drill forward in a straight line from the last slide. The driller alternates between rotating and sliding, to steer the wellbore as desired.

During the sliding portions of the drilling operation, the driller needs to ensure that the toolface (e.g. the orientation) of a mud motor/bent sub connected to the downhole tool is properly set, to point, using the bend in the mud motor, the drill bit in the desired direction.

SUMMARY

According to a first aspect of the disclosure, there is provided a method of controlling a toolface of a downhole tool, comprising: when a drill bit is off-bottom relative to a wellbore: determining a total amount of rotation to be introduced to a drill string connected to the drill bit; and performing a first toolface control operation comprising rotating the drill string by an off-bottom amount of rotation; measuring a differential pressure; determining, based on the measured differential pressure exceeding a threshold, that a touchdown condition has been met; and in response to determining that the touchdown condition has been met, performing a second toolface control operation comprising further rotating the drill string by an on-bottom amount of rotation, wherein the total amount of rotation is equal to a sum of the off-bottom and on-bottom amounts of rotation.

Rotating the drill string may comprise adjusting a rotary drive unit position setpoint corresponding to a desired position of a rotary drive unit operable to rotate the drill string. The rotary drive unit position setpoint may comprise a top drive position setpoint. The rotary drive unit may comprise a top drive.

The desired position of the rotary drive unit may comprise an angular position of the rotary drive unit or a midpoint or a neutral point of a range of angular positions within which the rotary drive unit is oscillated.

Determining the total amount of rotation may comprise: determining a difference between a differential pressure setpoint and an initial differential pressure; and determining the total amount of rotation based on the determined difference.

The total amount of rotation may be equal to (DiffP_Setpoint−DiffP)*ReactiveT_Factor, wherein DiffP_Setpoint is the differential pressure setpoint, DiffP is the initial differential pressure, and ReactiveT_Factor is a constant.

The method may further comprise, before performing the first toolface control operation, determining an initial differential pressure; and determining that the measured differential pressure has exceeded the threshold by: determining a differential pressure setpoint; and determining that the measured differential pressure is greater than a predetermined fraction of the differential pressure setpoint minus the initial differential pressure.

The off-bottom amount of rotation may be at least as large as the on-bottom amount of rotation.

Performing the first toolface control operation may comprise rotating the drill string by the off-bottom amount proportionally to increasing depth of the drill bit.

The method may further comprise, before performing the first toolface control operation, rotating the drill string by an initial amount of rotation.

The initial amount of rotation may correspond to a difference between an initial toolface of the downhole tool and a toolface setpoint.

The method may further comprise: before performing the first toolface control operation, determining an initial toolface of the downhole tool; and determining a toolface setpoint, wherein the initial toolface and the toolface setpoint define an expected toolface range; and further rotating the drill string if the toolface of the downhole tool is determined to be outside of the expected toolface range.

The method may further comprise, if the toolface of the downhole tool is determined to be outside of the expected toolface range, then redefining the expected toolface range based on the toolface setpoint and the toolface determined to be outside of the expected toolface range.

Performing the second toolface control operation may comprise further rotating the drill string by the on-bottom amount proportionally to increasing differential pressure.

The method may further comprise: after performing the second toolface control operation, determining that a depth of the drill bit corresponds to a depth of the wellbore; and in response to determining that the depth of the drill bit corresponds to the depth of the wellbore, performing a third toolface control operation comprising further rotating the drill string.

Performing the third toolface control operation may comprise: increasing a differential pressure setpoint such that the differential pressure setpoint corresponds to a reactive pressure; and further rotating the drill string based on the increased differential pressure setpoint.

The method may further comprise, after performing the second toolface control operation: determining a toolface error based on a difference between the toolface of the downhole tool and a toolface setpoint; adjusting, based on the toolface error, one or more drilling parameter setpoints; and inputting the one or more adjusted drilling parameter setpoints to one or more drilling controllers for controlling the toolface of the downhole tool.

Adjusting the one or more drilling parameter setpoints may comprise: selecting, based on the toolface error, one or more drilling parameter setpoints from among multiple drilling parameter setpoints; and adjusting the selected one or more drilling parameter setpoints.

Adjusting, based on the toolface error, the one or more drilling parameter setpoints may comprise adjusting the one or more drilling parameter setpoints with one or any combination of: a proportional controller; an integral controller; and a derivative controller.

According to a further aspect of the disclosure, there is provided a method of controlling a toolface of a downhole tool, comprising: determining the toolface of the downhole tool; determining a toolface setpoint; determining, based on the toolface and the toolface setpoint, a toolface error; selecting, based on the toolface error, one or more drilling parameter setpoints from among multiple drilling parameter setpoints; adjusting the selected one or more drilling parameter setpoints; and inputting the adjusted one or more drilling parameter setpoints to one or more drilling controllers for controlling the toolface of the downhole tool.

The toolface error may be indicative of one or more of: a magnitude of a difference between the toolface and the toolface setpoint; and a direction of a difference between the toolface and the toolface setpoint.

The one or more drilling parameter setpoints may comprise one or more of: a weight-on-bit (WOB) setpoint; a differential pressure setpoint; a rate of penetration (ROP) setpoint; and a rotary drive unit position setpoint.

The one or more drilling controllers may comprise one or more of an automated drilling unit and a rotary drive unit controller; and inputting the adjusted one or more drilling parameter setpoints to the one or more drilling controllers comprises: inputting the adjusted one or more drilling parameter setpoints to the automated drilling unit if the one or more drilling parameter setpoints comprise one or more of a WOB setpoint, an ROP setpoint, and a differential pressure setpoint; and inputting the adjusted one or more drilling parameter setpoints to the rotary drive unit controller if the one or more drilling parameter setpoints comprise a rotary drive unit position setpoint. The rotary drive unit may comprise a top drive, and the rotary drive unit position setpoint may comprise a top drive setpoint.

If the toolface error is indicative that the toolface setpoint is located in a counter-clockwise direction relative to the toolface of the downhole tool, then selecting the one or more drilling parameter setpoints may comprise selecting one or more first drilling parameter setpoints from among the multiple drilling parameter setpoints.

If the toolface error is indicative that the toolface setpoint is located in a clockwise direction relative to the toolface of the downhole tool, then selecting the one or more drilling parameter setpoints may comprise selecting one or more second drilling parameter setpoints from among the multiple drilling parameter setpoints.

If the toolface error is indicative that the toolface setpoint is located in a counter-clockwise direction relative to the toolface of the downhole tool, then adjusting the selected one or more drilling parameter setpoints may comprise adjusting one or more of a WOB setpoint, an ROP setpoint, and a differential pressure setpoint.

If the toolface error is indicative that the toolface setpoint is located in a clockwise direction relative to the toolface of the downhole tool, then adjusting the selected one or more drilling parameter setpoints may comprise adjusting a rotary drive unit position setpoint.

If the toolface error is indicative that a difference between the toolface setpoint and the toolface of the downhole tool is greater than about 90 degrees, then adjusting the selected one or more drilling parameter setpoints may comprise adjusting: one or more of a WOB setpoint, an ROP setpoint, and a differential pressure setpoint; and a rotary drive unit position setpoint.

If the toolface error is indicative that a difference between the toolface setpoint and the toolface of the downhole tool is less than about 90 degrees, then adjusting the selected one or more drilling parameter setpoints may comprise adjusting a rotary drive unit position setpoint.

Adjusting the selected one or more drilling parameter setpoints may comprise adjusting the selected one or more drilling parameter setpoints with one or any combination of: a proportional controller; an integral controller; and a derivative controller.

The method may further comprise: determining a difference between a differential pressure and a differential pressure setpoint; and in response thereto, adjusting a rotary drive unit position setpoint based on the determined difference.

The method may further comprise: determining a rate of change of a differential pressure; and in response thereto, adjusting a rotary drive unit position setpoint based on the determined rate of change.

According to a further aspect of the disclosure, there is provided a system for controlling a toolface of a downhole tool, the system comprising: a drill string comprising a downhole tool at a downhole end thereof; a drill bit connected to the downhole tool; and a toolface controller for controlling the toolface of the downhole tool, the toolface controller comprising computer-readable memory and one or more processors, wherein the compute-readable memory comprises computer program code configured, when executed by the one or more processors, to cause the one or more processors to perform any of the above-described methods.

According to a further aspect of the disclosure, there is provided a computer-readable medium having stored thereon computer program code configured, when executed by one or more processors, to cause the one or more processors to perform a method according to any of the above-described methods.

This summary does not necessarily describe the entire scope of all aspects. Other aspects, features and advantages will be apparent to those of ordinary skill in the art upon review of the following description of specific embodiments.

BRIEF DESCRIPTION OF THE DRAWINGS

In the accompanying drawings, which illustrate one or more example embodiments.

DETAILED DESCRIPTION

The present disclosure seeks to provide improved methods, systems, and computer-readable media for controlling a toolface of a downhole tool. While various embodiments of the disclosure are described below, the disclosure is not limited to these embodiments, and variations of these embodiments may well fall within the scope of the disclosure which is to be limited only by the appended claims.

Generally, according to embodiments of the disclosure, there are described methods, systems, and computer-readable media for controlling a toolface of a downhole tool. When the drill bit is off bottom, a toolface controller may cause the drill string to be rotated by a first amount before the drill bit is determined to have touched bottom, and by a second amount after the drill bit is determined to have touched bottom. The drill bit may be determined to have touched bottom based on differential pressure. The total amount of rotation that is introduced (i.e. the sum of the first and second amounts) may be based on a difference between an initial differential pressure and a differential pressure setpoint. The first amount of rotation may be introduced, for example, rapidly (e.g. substantially before the drill bit is determined to have touched bottom), or gradually as a function of increasing depth of the downhole tool. The second amount of rotation may be introduced, for example, rapidly (e.g. substantially before a differential pressure is determined to have reached a differential pressure setpoint), or gradually as a function of increasing differential pressure.

Subsequently to this initial control of the toolface as the drill bit is brought to the bottom of the wellbore, the toolface may continue to be controlled using, for example, a PID feedback controller. Based on a current toolface reading and based on a toolface setpoint (corresponding to a desired toolface), the toolface controller may determine which of multiple drilling parameter setpoints to adjust in order to control the toolface. The particular setpoint or setpoints that are adjusted may depend, for example, on the magnitude of the toolface error (e.g. a difference between the current toolface and the toolface setpoint) as well as the direction of desired correction to the toolface.

Figure 1:
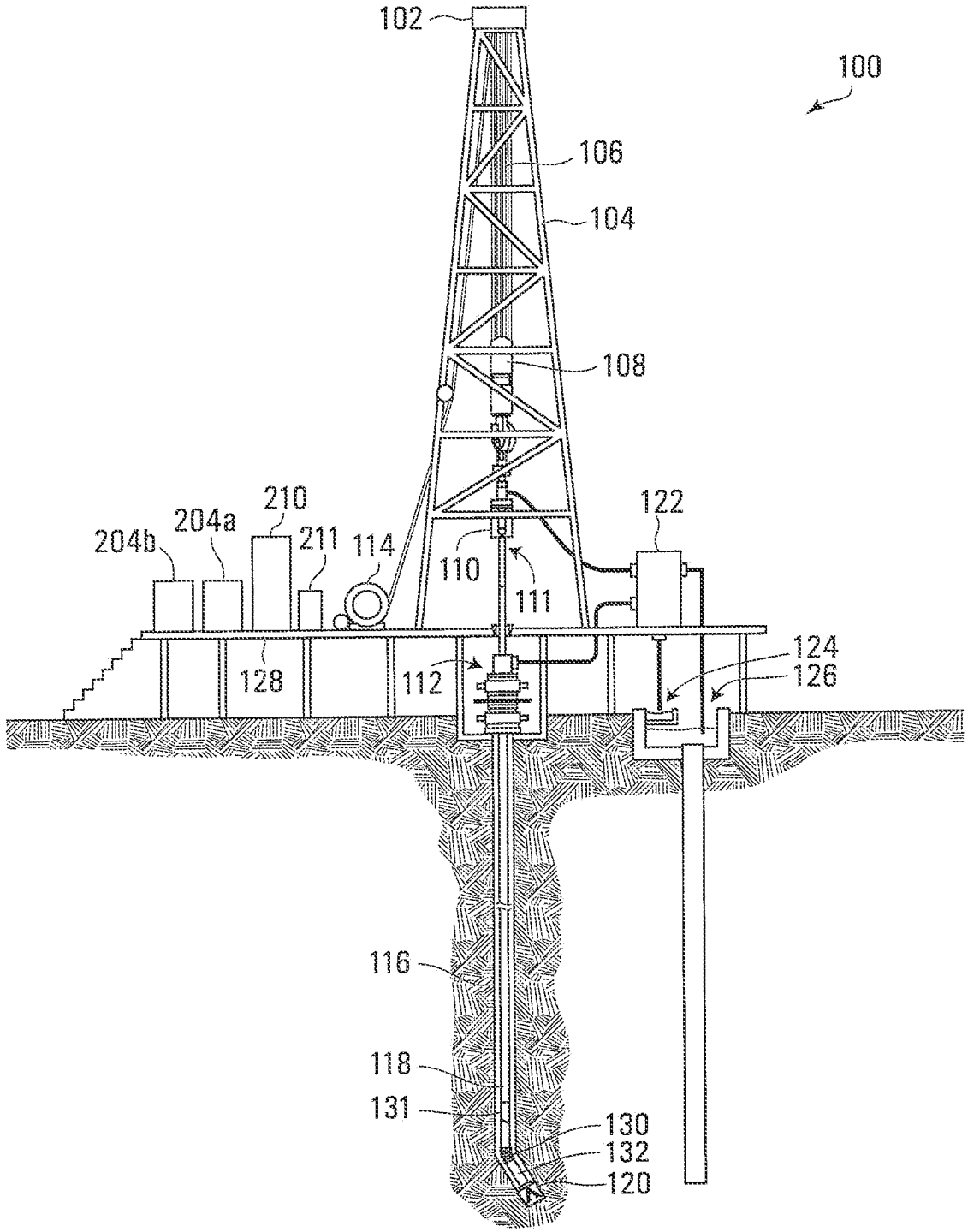
FIG. 1 is a schematic of a drilling rig, according to embodiments of the disclosure.

FIG. 1 shows a drilling rig 100, according to one embodiment. The rig 100 comprises a derrick 104 that supports a drill string 118. The drill string 118 has a drill bit 120 at its downhole end, which is used to drill a wellbore 116. A drawworks 114 is located on the drilling rig's 100 floor 128. A drill line 106 extends from the drawworks 114 to a traveling block 108 via a crown block 102. The traveling block 108 is connected to the drill string 118 via a top drive 110. The top drive 110 is connected to the drill string 118 by a tubular section known as a quill 111. Rotating the drawworks 114 consequently is able to change weight-on-bit (WOB) during drilling, with rotation in one direction lifting the traveling block 108 and generally reducing WOB and rotation in the opposite direction lowering the traveling block 108 and generally increasing WOB. The drill string 118 also comprises, near the drill bit 120, a bent sub 130 and a mud motor 132. The mud motor's 132 rotation is powered by the flow of drilling mud through the drill string 118, as discussed in further detail below, and combined with the bent sub 130 permits the rig 100 to perform directional drilling. The top drive 110 and mud motor 132 collectively provide rotational force to the drill bit 120 that is used to rotate the drill bit 120 and drill the wellbore 116. While in FIG. 1 the top drive 110 is shown as an example rotational drive unit, in a different embodiment (not depicted) another rotational drive unit may be used, such as a rotary table.

A mud pump 122 rests on the floor 128 and is fluidly coupled to a shale shaker 124 and to a mud tank 126. The mud pump 122 pumps mud from the tank 126 into the drill string 118 at or near the top drive 110, and mud that has circulated through the drill string 118 and the wellbore 116 return to the surface via a blowout preventer ("BOP") 112. The returned mud is routed to the shale shaker 124 for filtering and is subsequently returned to the tank 126.

Uphole of the bent sub 130 is located a measurement-while-drilling (MWD) tool 131. MWD tool 131 collects and transmits data from inside the wellbore 116, such as formation properties, rotational speed, vibration, temperature, torque, pressure, and mud flow. The MWD tool 131 measures the inclination, azimuth, and toolface orientation of a downhole tool near the drill bit 120. Toolface orientation (or simply "toolface") combined with inclination, azimuth, and the geometry of the bottom hole assembly can be used to determine the trajectory of the drill string 118.

The MWD data may be transferred to the surface using any of various means, such as mud pulse telemetry, electromagnetic telemetry (generally for relatively shallow depths), acoustic telemetry, or a wired drill pipe. The MWD data is decoded at the surface by an MWD decoder 211. Generally, the decoded MWD data is sent to a directional driller's workstation and doghouse computer (see below).

Figure 2:
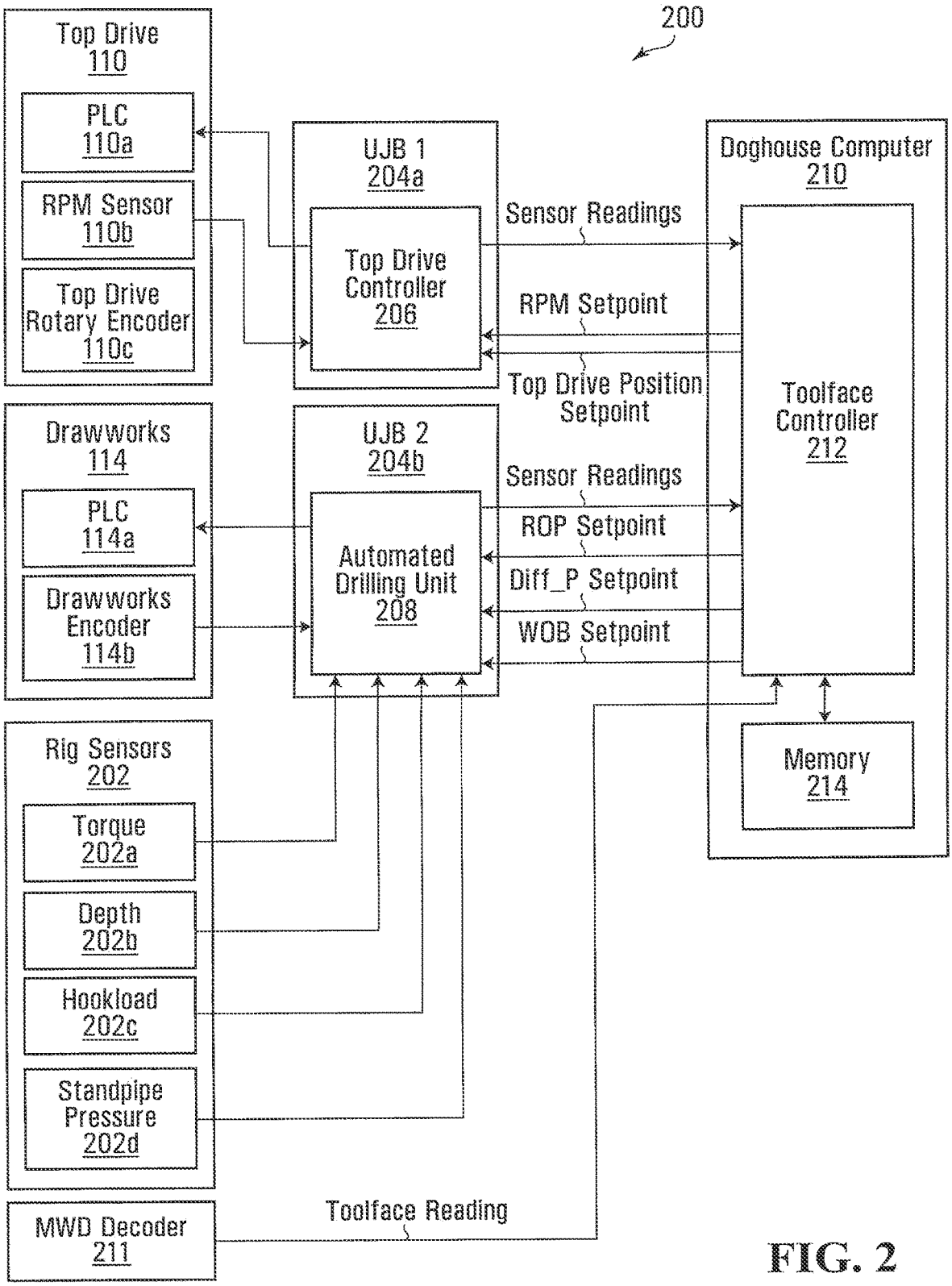
FIG. 2 is a block diagram of a system for performing automated drilling of a wellbore, according to embodiments of the disclosure.

FIG. 2 shows a block diagram of a system 200 for performing automated drilling of a wellbore, according to the embodiment of FIG. 1. The system 200 comprises various rig sensors: a torque sensor 202*a*, depth sensor 202*b*, hookload sensor 202*c*, and standpipe pressure sensor 202*d* (collectively, "sensors 202").

The system 200 also comprises the drawworks 114 and top drive 110. The drawworks 114 comprises a programmable logic controller ("drawworks PLC") 114*a* that controls the drawworks' 114 rotation and a drawworks encoder 114*b* that outputs a value corresponding to the current height of the traveling block 108. The top drive 110 comprises a top drive programmable logic controller ("top drive PLC") 110*a* that controls the top drive's 114 rotation and a revolutions-per-minute (RPM) sensor 110*b* that outputs the rotational rate of the drill string 118. More generally, the top drive PLC 110*a* is an example of a rotational drive unit controller and the RPM sensor 110*b* is an example of a rotation rate sensor. In addition, top drive 110 further includes a top drive rotary encoder 110*c* (mounted within or externally to the top drive 110). Top drive rotary encoder 110*c* is used to measure the angle of rotation of quill 111. Top drive rotary encoder 110*c* is an example of a rotational position sensor and is used to provide a feedback signal for controlling the toolface of the downhole tool, as described in further detail below.

A first junction box 204*a* houses a top drive controller 206, which is communicatively coupled to the top drive PLC 110*a*, the RPM sensor 110*b*, and the top drive rotary encoder 110*c*. The top drive controller 206 controls the rotation rate of the drill string 118 by instructing the top drive PLC 110*a* and obtains the rotational position, rate of rotation, and direction of rotation of the drill string 118 from top drive rotary encoder 110*c*.

A second junction box 204*b* houses an automated drilling unit 208 (or simply "automatic driller 208"), which is communicatively coupled to the drawworks PLC 114*a* and the drawworks encoder 114*b*. The automated drilling unit 208 modulates WOB during drilling by instructing the drawworks PLC 114*a* and obtains the height of the traveling block 108 from the drawworks encoder 114*b*. In different embodiments, the height of the traveling block 108 can be obtained digitally from rig instrumentation, such as directly from the PLC 114*a* in digital form. In different embodiments (not depicted), the junction boxes 204*a*,204*b* may be combined in a single junction box, comprise part of the doghouse computer 210, or be connected indirectly to the doghouse computer 210 by an additional desktop or laptop computer.

The automated drilling unit 208 is also communicatively coupled to each of the sensors 202. In particular, the automated drilling unit 208 determines WOB from the hookload sensor 202*c* and determines the rate of penetration (ROP) of the drill bit 120 by monitoring the height of the traveling block 108 over time.

The system 200 also comprises a doghouse computer 210. The doghouse computer 210 comprises a toolface controller 212 and memory 214 communicatively coupled to each other. The memory 214 stores on it computer program code that is executable by the toolface controller 212 and that, when executed, causes the toolface controller 212 to perform methods for performing automated drilling of the wellbore 116. In particular, the toolface controller 212 may perform methods for controlling a toolface of the downhole tool, such as those shown in FIGS. 7 and 8. The toolface controller 212 receives readings from the RPM sensor 110*b*, drawworks encoder 114*b*, top drive rotary encoder 110*c*, and the rig sensors 202. MWD decoder 211, having received a toolface reading from downhole MWD tool 131, transmits the toolface reading directly to toolface controller 212.

The toolface controller 212 sends one or more of an ROP setpoint, a differential pressure setpoint, and a WOB setpoint to the automated drilling unit 208, and one or more of an RPM setpoint and a top drive position setpoint to the top drive controller 206. The top drive position setpoint may include a rotational position setpoint of the top drive 110 (indicative of a desired rotational position of the top drive 110), or a rotational position setpoint indicative of a target midpoint about which the top drive 110 is oscillated (or a target neutral point in the case of asymmetric oscillations). The top drive controller 206 and automated drilling unit 208 relay these setpoints to the top drive PLC 110*a* and drawworks PLC 114*a*, respectively, where they are used for automated drilling.

Each of the first and second junction boxes may comprise a Pason Universal Junction Box™ (UJB) manufactured by Pason Systems Corp. of Calgary, Alberta. The automated drilling unit 208 may be a Pason Autodriller™ manufactured by Pason Systems Corp. of Calgary, Alberta.

The top drive controller 206, automated drilling unit 208, and doghouse computer 210 are respective example types of drilling controllers. In the system 200 of FIG. 2, the top drive controller 206206 and the automated drilling unit 208 are distinct and respectively use the RPM and top drive position setpoints, and the WOB, differential pressure, and ROP setpoints, for automated drilling. However, in different embodiments (not depicted), the functionality of the top drive controller 206 and automated drilling unit 208 may be combined or may be divided between three or more controllers. In certain embodiments (not depicted), the toolface controller 212 may directly communicate with any one or more of the top drive 110, drawworks 114, sensors 202, and MWD decoder 211. Additionally or alternatively, in different embodiments (not depicted) automated drilling may be done in response to only the RPM setpoint, only the ROP setpoint, only the WOB setpoint, only the differential pressure setpoint, only the top drive position setpoint, or any combination thereof, possibly in combination with one or more other drilling parameters. Examples of these additional drilling parameters comprise, for example, depth of cut, torque, and flow rate (into the wellbore 116, out of the wellbore 116, or both).

In the depicted embodiments, the top drive controller 206 and the automated drilling unit 208 acquire data from the sensors 202 discretely in time at a sampling frequency F_s, and this is also the rate at which the doghouse computer 210 acquires the sampled data. Accordingly, for a given period T, N samples are acquired with N=TF_s. In different embodiments (not depicted), the doghouse computer 210 may receive the data at a different rate than that at which it is sampled from the sensors 202. Additionally or alternatively, the top drive controller 206 and the automated drilling unit 208 may sample data at different rates, and more generally in embodiments in which different equipment is used data may be sampled from different sensors 202 at different rates.

Figure 3:
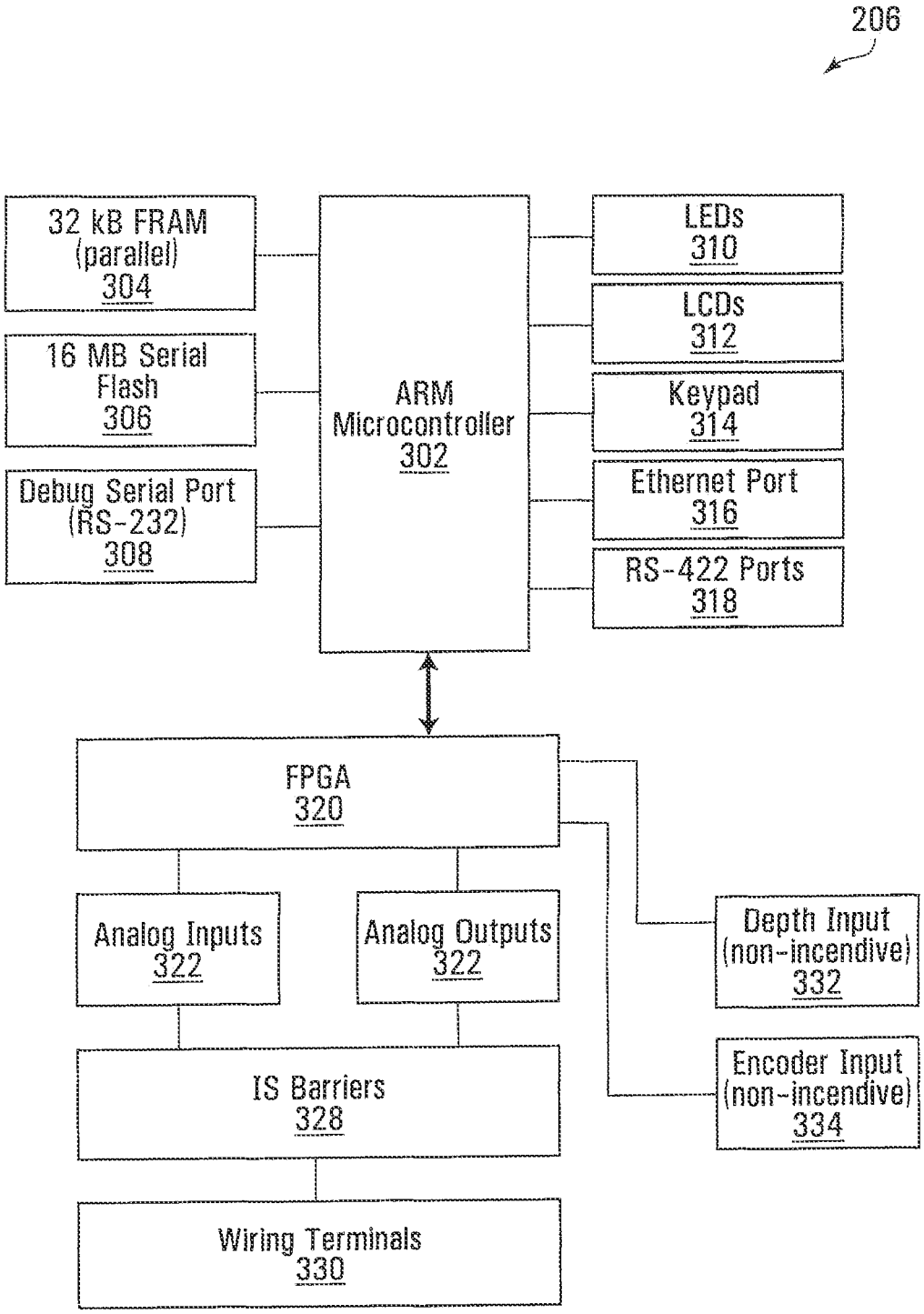
FIG. 3 depicts a block diagram of the automatic driller of FIG. 1.

Referring now to FIG. 3, there is shown a hardware block diagram 300 of the second junction box 204*b* of FIG. 2. The second junction box 204*b* comprises a microcontroller 302 communicatively coupled to a field programmable gate array ("FPGA") 320. The depicted microcontroller 302 is an ARM-based microcontroller, although in different embodiments (not depicted) the microcontroller 302 may use a different architecture. The microcontroller 302 is communicatively coupled to 32 kB of non-volatile random access memory ("RAM") in the form of ferroelectric RAM 304; 16 MB of flash memory 306; a serial port 308 used for debugging purposes; LEDs 310, LCDs 312, and a keypad 314 to permit a driller to interface with the automatic driller 208; and communication ports in the form of an Ethernet port 316 and RS-422 ports 318. While FIG. 3 shows the microcontroller 302 in combination with the FPGA 320, in different embodiments (not depicted) different hardware may be used. For example, the microcontroller 302 may be used to perform the functionality of both the FPGA 320 and microcontroller 302 in FIG. 3; alternatively, a PLC may be used in place of one or both of the microcontroller 302 and the FPGA 320.

The microcontroller 302 communicates with the hookload and standpipe pressure sensors 202*c*,202*d* via the FPGA 320. More specifically, the FPGA 320 receives signals from these sensors 202*c*,202*d* as analog inputs 322; the FPGA 320 is also able to send analog signals using analog outputs 324. These inputs 322 and outputs 324 are routed through intrinsic safety ("IS") barriers for safety purposes, and through wiring terminals 330. The microcontroller 302 communicates using the RS-422 ports 318 to the PLC 114*a*; accordingly, the microcontroller 302 receives signals from a block height sensor (not shown) and the torque sensor 202*a* and sends signals to a variable frequency drive (or, in some embodiments, a braking device) via the RS-422 ports 318. According to some embodiments, automatic driller 208 outputs a throttle signal to a PLC using an analog output. According to some embodiments, automatic driller 208 communicates with a band brake controller using an RS-422 port.

The FPGA 320 is also communicatively coupled to a non-incendive depth input 332 and a non-incendive encoder input 334. In different embodiments (not depicted), the automatic driller may receive different sensor readings in addition to or as an alternative to the readings obtained using the depicted sensors 202*a*,202*b*,202*c*,202*d*.

First junction box 204*a*, comprising top drive controller 206, comprises an input/output architecture similar to that of second junction box 204*b* shown in FIG. 3. However, the RS-422 port is not used, and all an inputs/outputs use analog or discrete digital signaling.

Figure 4:
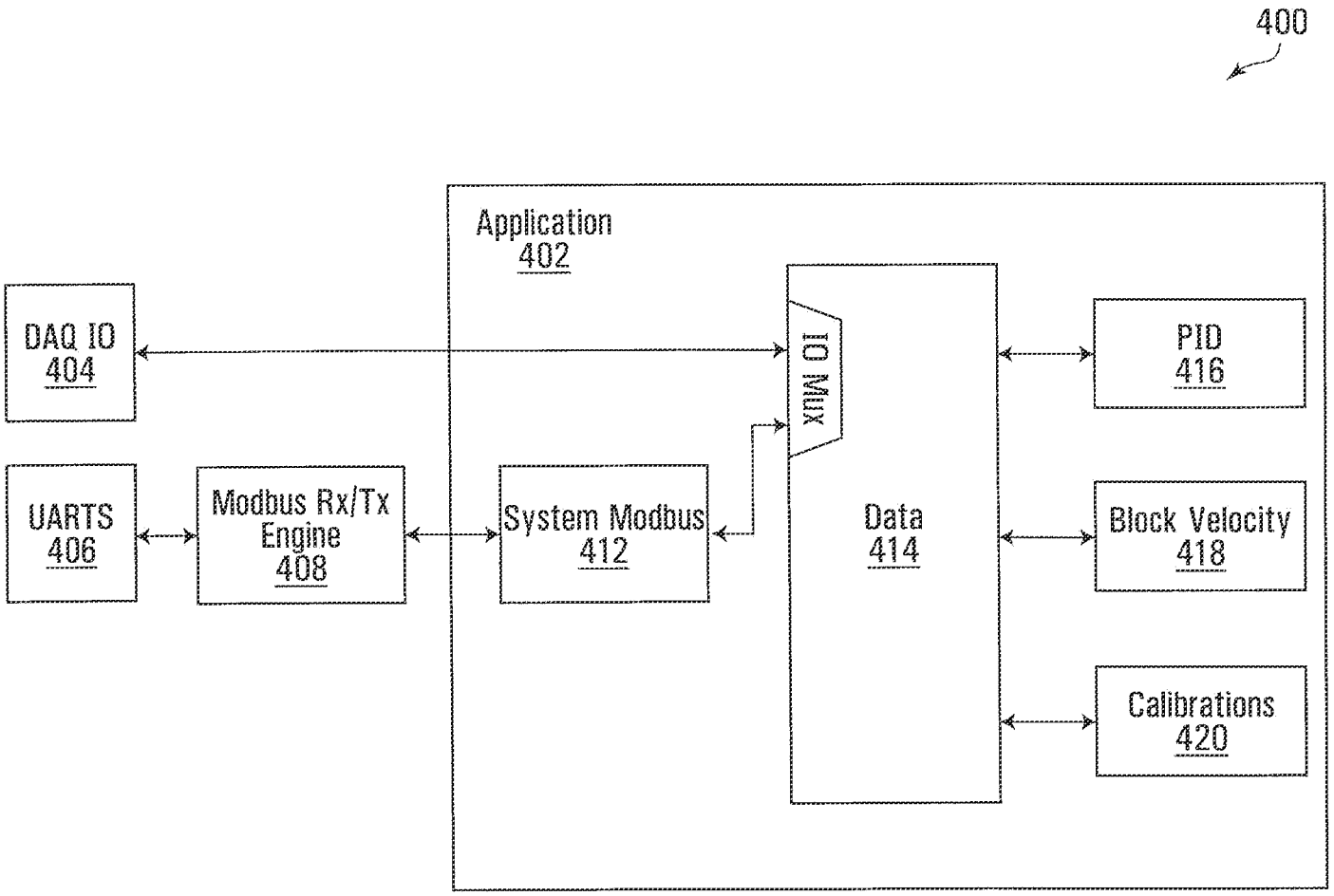
FIG. 4 depicts a block diagram of software modules running on the automatic driller of FIG. 1.

Referring now to FIG. 4, there is shown a block diagram of software modules, some of which comprise a software application 402, running on the automatic driller of FIG. 3. The application 402 comprises a data module 414 that is communicative with a PID module 416, a block velocity module 418, and a calibrations module 420. The microcontroller 302 runs multiple PID control loops in order to determine the signal to send to the PLC 114*a* to control the variable frequency drive; the microcontroller 302 does this in the PID module 416. The microcontroller 302 uses the block velocity module 418 to determine the velocity of the traveling block 108 from the traveling block height derived using measurements from the block height sensor. The microcontroller 302 uses the calibrations module 420 to convert the electrical signals received from the sensors 202*a*,202*b*,202*c*,202*d* into engineering units; for example, to convert a current signal from mA into kilopounds.

The data module 414 also communicates using an input/output multiplexer, labeled "IO Mux" in FIG. 4. In one of the multiplexer states the data module 414 communicates digitally via the Modbus protocol using the system modbus 412 module, which is communicative with a Modbus receive/transmit engine 408 and the UARTS 406. In another of the multiplexer states, the data module 414 communicates analog data directly using the data acquisition in/out module 404. While in FIG. 4 the Modbus protocol is shown as being used, in different embodiments (not depicted) a different protocol may be used, such as another suitable industrial bus communication protocol.

During drilling, a reactive torque is produced by the mud motor 132 that may cause the toolface to rotate to the left. Differential pressure may be used as a proxy for reactive torque. Differential pressure is roughly the difference between on- and off-bottom standpipe pressure which may be a proxy for the pressure loss across the mud motor 132. In practice, it is easier to increase differential pressure than to decrease differential pressure. In general, it may be preferable to increase differential pressure so as to allow drilling rig 100 to drill faster. Increasing differential pressure may generally translate into increasing WOB, resulting in a higher reactive torque. If a leftward toolface correction is required, differential pressure may be increased to produce a left turn and increased ROP. Using differential pressure for rightward toolface corrections may require reducing differential pressure, accomplished through drilling off WOB, and may translate into slower drilling. Therefore, rightward toolface corrections may be better accomplished through changes to the rotational position of the top drive 110.

Figure 5:
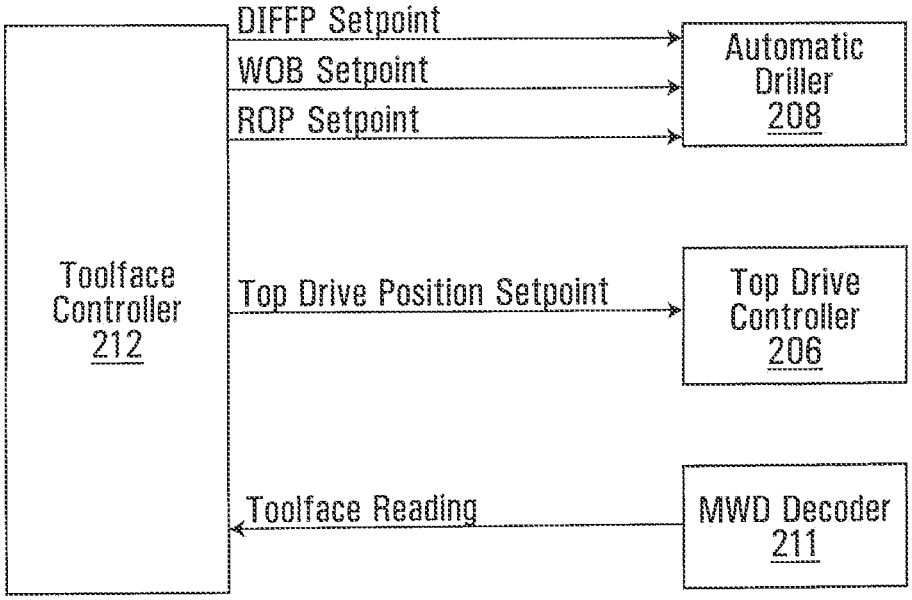
FIG. 5 depicts a block diagram of a toolface controller interacting with the automatic driller and top drive controller of FIG. 2, according to embodiments of the disclosure.

Turning to FIG. 5, there is shown a block diagram of toolface controller 212 interacting with automatic driller 208, top drive controller 206, and MWD decoder 211. As described in further detail below, toolface controller 212 determines, depending on the desired toolface correction, adjustments to one or more drilling parameter setpoints, and inputs the adjusted drilling parameter setpoint(s) to automatic driller 208 and/or top drive controller 206 to correct the toolface of the downhole tool, e.g. by minimizing a difference between a measured toolface and the toolface setpoint (e.g. a desired toolface).

As described above, top drive controller 206 manages the rotation of drill string 118, controls the oscillation of drill string 118, and effects changes to the rotational position of top drive 110. When performing rotational drilling, top drive controller 206 rotates drill string 118 constantly in the same direction (e.g. to the right). When sliding, in order to maintain toolface control, top drive controller 206 provides changes to one or more of a rotational position of the top drive 110 and a midpoint (or neutral point) about which the top drive 110 is oscillated. Generally, when sliding in the lateral, top drive controller 206 oscillates the top of drill string 118 a set amount in each direction. This reduces friction along drill string 118 and allows for smoother sliding. The amount of oscillation is chosen to allow most of drill string 118 to have some rotation without this rotation reaching the downhole tool. Changes to the midpoint or neutral point of this oscillation will propagate to the toolface over time. While oscillation can be used during vertical drilling and in the build, it is generally more often used while drilling in the lateral.

MWD decoder 211 receives from MWD tool 131 encoded data relating the toolface of the downhole tool (e.g. every 30 seconds, for example). MWD decoder 211 may decode the data to determine the current toolface and provides the toolface reading to toolface controller 212. MWD decoding can be performed through a variety of means, depending on how the data is sent. If the data is transmitted using mud-pulse telemetry, then MWD decoder 211 uses pressure information from a pressure sensor, such as standpipe pressure sensor 202*d*, to identify signals sent through the mud. MWD decoder 211 decodes the data and sends the toolface reading to toolface controller 212. The frequency of the updates to the current toolface may depend on equipment, conditions, and depth. When a toolface reading is received from MWD decoder 211, toolface controller 212 determines the magnitude of the required correction and determines whether to correct using automatic driller 208, top drive controller 206, or a combination of both. Generally, for small corrections, top drive controller 206 is used if the correction requires a right turn while automatic driller 208 if the correction requires a left turn. If the required correction is large, both top drive controller 206 and automatic driller 208 may be used. Large corrections and small corrections may be defined by the user. For example, according to some embodiments, a large correction may be a correction greater than 90 degrees, and, according to some embodiments, a small correction may be a correction between about 5 degrees and 90 degrees. Toolface controller 212 may use a proportional-integral-derivative (PID) controller for controlling the toolface.

Figure 6:
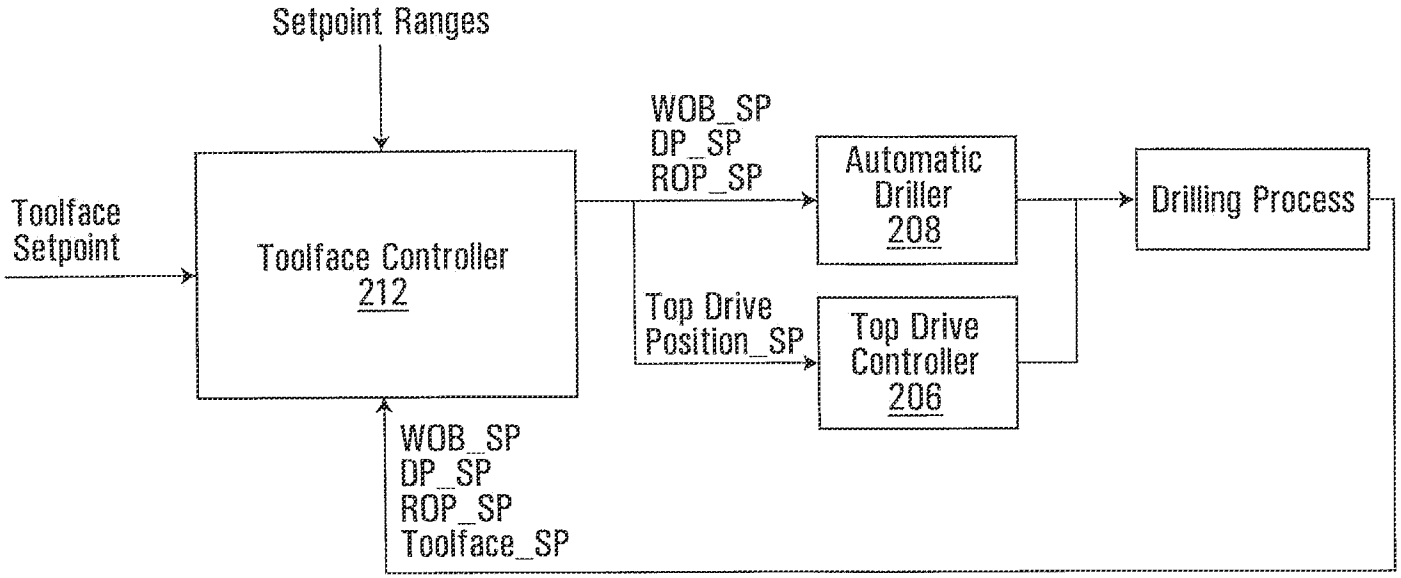
FIG. 6 depicts the toolface controller of FIG. 5 adjusting drilling parameter setpoints in a feedback control loop, according to embodiments of the disclosure.

Turning to FIG. 6, there is shown a feedback control loop for controlling, with toolface controller 212, the toolface of the downhole tool. A toolface setpoint, corresponding to a desired toolface, is input by an operator and provided to toolface controller 212. A current toolface of drill bit 120 is provided to toolface controller 212 by MWD decoder 211. WOB, ROP, and differential pressure setpoint ranges are also provided to toolface controller 212. Based on the toolface setpoint and based on the most recent toolface reading provided to toolface controller 212, toolface controller 212 determines a toolface error. The toolface error may be indicative of a magnitude of a difference between the toolface reading and the toolface setpoint. Based on the toolface error, toolface controller 212 selects and adjusts one or more drilling parameter setpoints for controlling the toolface, i.e. for reducing a magnitude of a difference between the current toolface and the toolface setpoint, as described in further detail below. The drilling parameter setpoints that may be adjusted include a WOB setpoint, a differential pressure setpoint, an ROP setpoint, and a top drive position setpoint. The WOB, ROP, and differential pressure setpoints may only be adjusted within the WOB, ROP, and differential pressure setpoint ranges provided to toolface controller 212.

The adjusted drilling parameter setpoints are input to either, or both of, automatic driller 208 and top drive controller 206, depending on which setpoint or setpoints are adjusted. In particular, adjustments to the WOB setpoint, the differential pressure setpoint, and the ROP setpoint are provided to automatic driller 208. Adjustments to the top drive position setpoint are provided to top drive controller 206. The adjusted setpoint or setpoints result in appropriate adjustment to the toolface of the downhole tool. Toolface controller 212 may adjust the one or more drilling parameter setpoints using, for example, a proportional-integral-derivative (PID) control loop, or in some cases a proportional-integral (PI) control loop.

Figure 7:
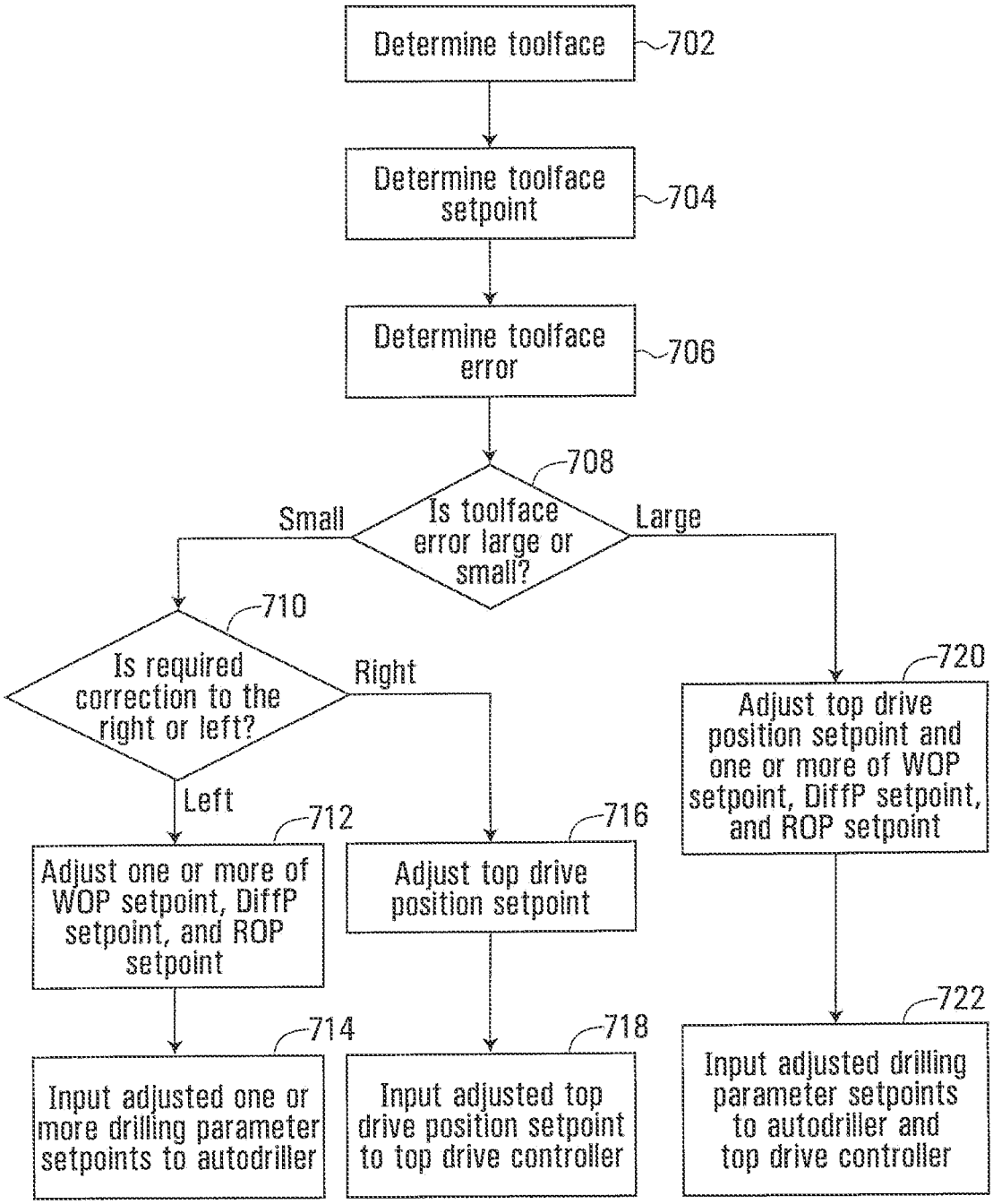
FIG. 7 depicts a flow diagram of a method of controlling a toolface of a downhole tool, according to embodiments of the disclosure.

Turning to FIG. 7, there is shown a flow diagram illustrating a method of controlling the toolface of the downhole tool, using toolface controller 212, according to embodiments of the disclosure.

At block 702, a toolface of the downhole tool is determined. For example, the most recent toolface reading sent from MWD decoder 211 to toolface controller 212 may be used for determining the current toolface. At block 704, a toolface setpoint is determined. The toolface setpoint may be whatever setpoint is provided to toolface controller 212 by the operator. At block 706, toolface controller 212 determines a toolface error. The toolface error may be determined based on one or more differences (e.g. magnitude, direction) between the current toolface and the toolface setpoint.

At block 708, toolface controller 212 determines whether the toolface error is large or small. The difference between a large toolface error and a small toolface error may be configured by the operator, for example. According to some embodiments, a toolface error between about 5 degrees and about 90 degrees may constitute a small toolface error, while a toolface error greater than about 90 degrees may constitute a large toolface error.

If the toolface error is considered to be small, then, at block 710, toolface controller 212 determines whether the required correction is to the left or to the right. If the required correction is to the left, then, at block 712, toolface controller 212 adjusts one or more of the WOB setpoint, the differential pressure setpoint, and the ROP setpoint. At block 714, toolface controller 212 inputs the adjusted one or more drilling parameter setpoints to automatic driller 208.

If the required correction is to the right, then, at block 716, toolface controller 212 adjusts the top drive position setpoint. At block 718, toolface controller 212 inputs the adjusted top drive position setpoint to top drive controller 206.

If on the other hand the toolface error is considered to the large, then, at block 720, toolface controller 212 adjusts one or more of the WOB setpoint, the differential pressure setpoint, and the ROP setpoint, and additionally adjusts the top drive position setpoint. At block 722, toolface controller 212 inputs the adjusted drilling parameter setpoints to both automatic driller 208 and to top drive controller 206.

When correcting to the left, the intent as explained above is to increase the differential pressure. The most efficient way of accomplishing this may be is dependent, for example, on the automatic driller 208, the current formation being drilled, and/or user preference. A common case is as follows. If toolface controller 212 determines that the differential pressure may be safely increased (e.g. the current differential pressure is relatively close to the differential pressure setpoint, and is stable), if the WOB, ROP, and differential pressure setpoints are not at their maximum allowable values, and if the toolface error is considered small (as per above), then toolface controller 212 will increase the differential pressure setpoint. In addition, toolface controller 212 will adjust the WOB setpoint and optionally the ROP setpoint to enable the differential pressure to increase toward the new differential pressure setpoint. The magnitude of the setpoints increases will depend on various factors, such as on or more of: proportional, integral, and derivative values associated with the toolface error, pre-set gains, gains dependent on user input (such as ReactiveT_Factor—see below), gains dependent on analysis of the history of the relationship between toolface and differential pressure, and both pre-set and user-adjusted minimum and maximum allowable values.

Toolface controller 212 may additionally perform a differential pressure compensation operation, for example at regular intervals. When performing the differential pressure compensation operation, toolface controller 212 determines a difference between the current differential pressure and the differential pressure setpoint, as well as a rate of change of differential pressure relative to the differential pressure setpoint. Based on the difference between the current differential pressure and the differential pressure setpoint, as well as the rate of change of differential pressure relative to the differential pressure setpoint, toolface controller 212 may adjust the top drive position setpoint. The amount by which the top drive position setpoint is adjusted may be of the form (DiffP−DiffP_Setpoint) *ReactiveT_Factor*Scaling_Factor. In addition, or alternatively, the amount by which the top drive position setpoint is adjusted may be of the form DiffP_Derivative*ReactiveT_Factor*Scaling_Factor. ReactiveT_Factor is a constant that defines a relationship between differential pressure and pipe twist (e.g. 90 degrees per 1,000 kPa), and is an approximation of the spring constant of the pipe. ReactiveT_Factor and Scaling_Factor are generally user-entered and reflect, for a given differential pressure, the amount the top drive has to be rotated in order to maintain a stable toolface. By performing the differential pressure compensation operation, toolface controller 212 smooths changes in differential torque. Since it may take a significant amount of time for any change at the surface to reach the toolface, this input is scaled using Scaling_Factor, with the intention being that, over time, the adjustments will stabilize the toolface. In general, when sliding, ROP is low (1-50 m/h with a typical speed of 8-10 m/h) and it may take several minutes for an adjustment to propagate downhole.

If multiple processes (toolface control, differential pressure compensation, and/or other currently available or future developed processes) require concurrent changes to be sent to automatic driller 208 and/or top drive controller 206, their outputs are summed.

Separate to ongoing toolface control, toolface controller 212 controls how and when compensation for reactive torque is introduced to the drill string 118 when drill bit 120 is going to bottom. This can occur, for example, after a connection, after switching from rotational drilling to slide drilling, when toolface control is lost and drill bit 120 is raised from the bottom to re-establish toolface control, or when toolface control is halted to allow WOB to drill off. As drill bit 120 nears the bottom of the wellbore, a first amount of the total desired rotation of drill string 118 is added by top drive controller 206, and the remainder of the total desired rotation is added after drill bit 120 touches bottom. According to some embodiments, about 80% of the total desired rotation is added before drill bit 120 touches bottom. The point at which drill bit 120 touches bottom may be detected based on differential pressure alone, or based on a combination of differential pressure and one or more comparisons of bit depth and hole depth. Differential pressure, instead of bit/hole depth, is used to determine contact, as instead of bit/hole depth may be inaccurate and can be affected by pipe stretch. The timing of the introduction of rotation of drill string 118 is based on off-bottom distance and differential pressure, or based on a distance drilled since touching bottom.

Figure 8:
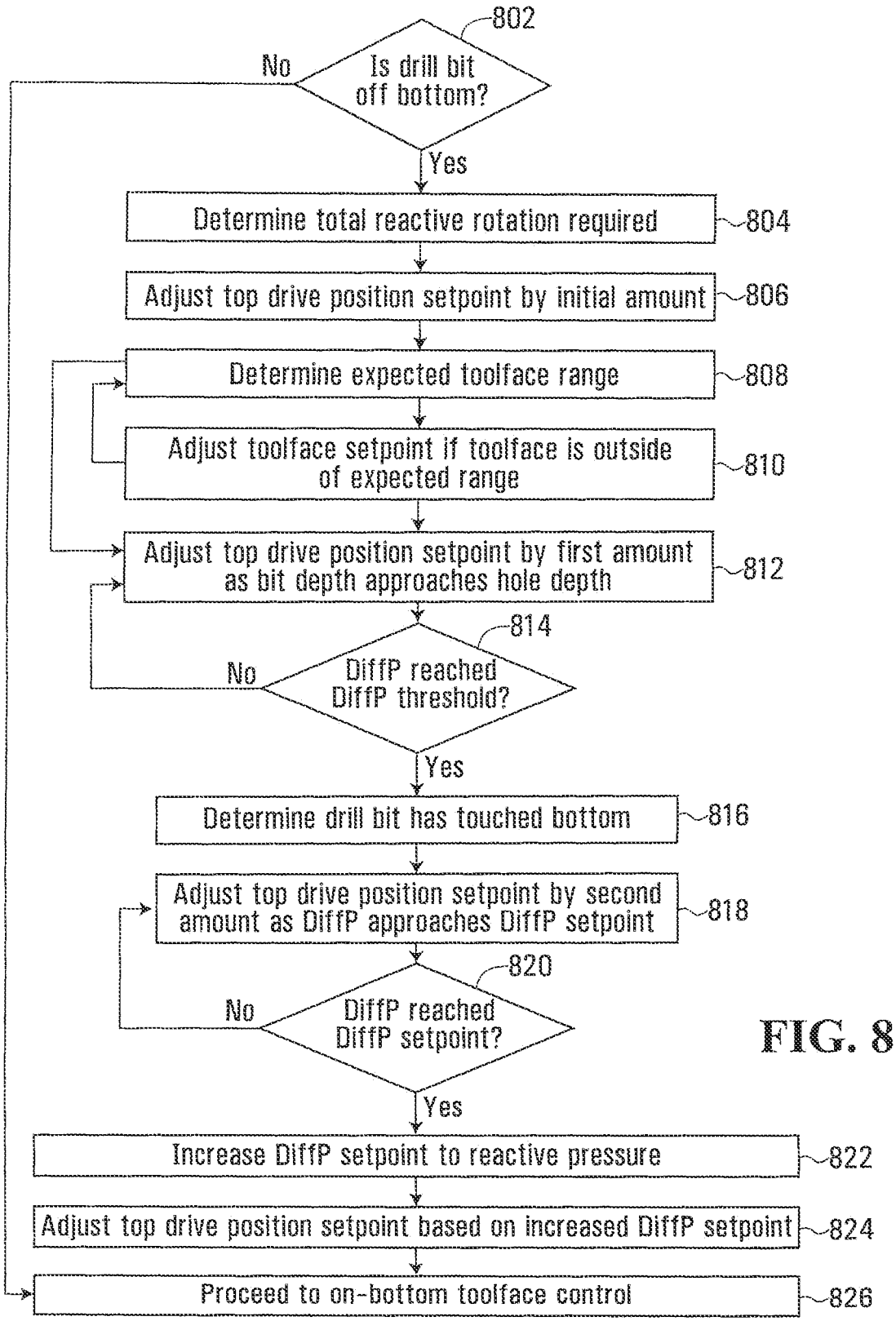
FIG. 8 depicts a flow diagram of a further method of controlling a toolface of a downhole tool, according to embodiments of the disclosure.

Turning to FIG. 8, there is shown a flow diagram illustrating a method of controlling a toolface when a drill bit is off-bottom and going to bottom, according to embodiments of the disclosure.

At block 802, toolface controller 212 determines whether drill bit 120 is off bottom. For example, toolface controller 212 may determine that drill bit 120 is off bottom if a current depth of drill bit 120 as read by a suitable depth sensor is less than a depth of the wellbore, and if the current differential pressure is greater than 0. If drill bit 120 is determined to not be off bottom (e.g. the drill bit is on bottom), then the process may proceed to block 826 where on-bottom toolface control is performed. For example, when performing on-bottom toolface control, the toolface may be controlled using the method described above in connection with FIG. 7. If drill bit 120 is determined to be off bottom, then the process proceeds to block 804. In addition, the differential pressure setpoint may be initialized by using either the current different pressure setpoint or, if none is available, then setting the differential pressure setpoint to the current reactive pressure reading.

At block 804, toolface controller 212 determines the total reactive rotation that is required. The total reactive rotation that is required may be determined according to (DiffP_Setpoint−DiffP)*ReactiveT_Factor, where ReactiveT_Factor is the number of degrees of rotation required per unit of kPa (this constant may be set by the operator or may be calculated on the fly) to counteract the expected change in toolface as drill bit 120 moves to the bottom of the wellbore.

At block 806, toolface controller 212 adjusts the top drive position setpoint by an amount corresponding to the initial toolface error (e.g. the difference between the current toolface and the toolface setpoint). At block 808, toolface controller 212 determines an expected toolface range. The expected toolface range may be defined as the difference between the current toolface and the toolface setpoint, and corresponds to a range within which it is expected that the toolface will vary as drill bit 120 moves to the bottom of the wellbore.

Figure 9:
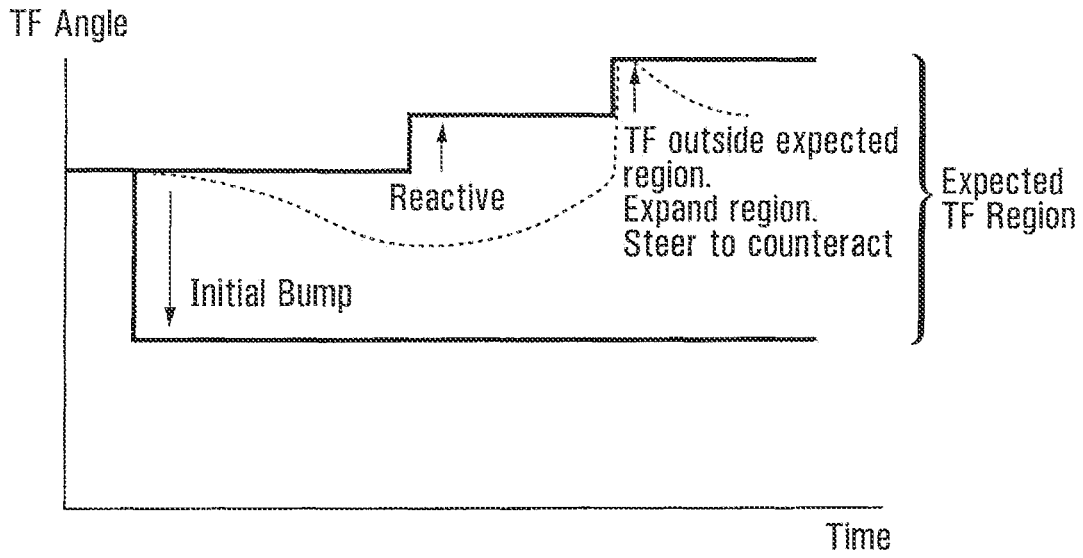
FIG. 9 is a plot of off-bottom reactive rotation being introduced as a function of off-bottom distance separating a drill bit from a bottom of a wellbore, according to embodiments of the disclosure.

At block 810, toolface controller 212 determines whether the current toolface is outside of the expected toolface range and, if so, then toolface controller 212 adjusts the top drive position setpoint so as to steer the toolface toward the expected toolface range. When the toolface is determined to be outside of the expected toolface range, the expected toolface range is widened accordingly to encompass the current toolface reading. Block 810 may be repeated until the method of FIG. 8 is completed. FIG. 9 is a plot showing adjustments to the expected toolface range as the drill bit 120 approaches the bottom of the wellbore. The expected toolface range is adjusted both in response to reactive rotation that is introduced into drill string 118 as well as in response to the current toolface being determined to be outside of the expected toolface range. The "initial bump" shown in FIG. 9 corresponds to the adjustment of the top drive position setpoint by the amount corresponding to the initial toolface error (block 806).

Figure 10:
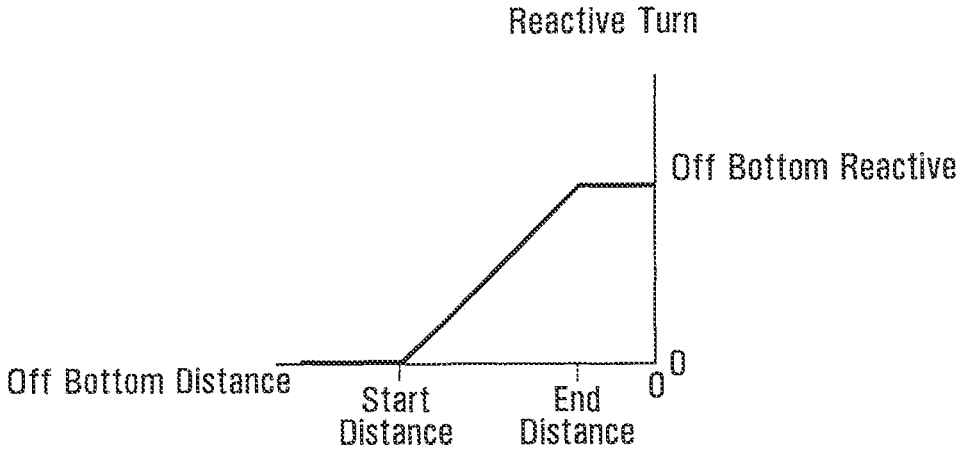
FIG. 10 is a plot of an expected toolface range being adjusted as a drill bit approaches a bottom of a wellbore, according to embodiments of the disclosure.

At block 812, toolface controller 212 introduces a first amount (i.e. an off-bottom amount) of reactive rotation into drill string 118, by adjusting the top drive position setpoint. In particular, as bit depth increases (i.e. as drill bit 120 approaches the bottom of the wellbore), the top drive position setpoint is further adjusted in a constant direction in order to rotate drill string 118. The total amount of off-bottom rotation that drill string 118 undergoes depends on the fraction of the total required reactive rotation (as determined at block 804) that the operator wishes to introduce before drill bit 120 is determined to have touched bottom vs. the fraction of the total required reactive rotation that the operator wishes to introduce after drill bit 120 is determined to have touched bottom. FIG. 10 shows an example of off-bottom reactive rotation being introduced proportionally to bit depth. According to some embodiments, instead of the off-bottom reactive rotation being introduced gradually as a function of bit depth, the off-bottom reactive rotation may be introduced independently of bit depth, and in some cases may be introduced rapidly, before drill bit 120 is determined to have touched bottom.

At block 814, toolface controller 212 determines whether the differential pressure has reached a predetermined differential pressure threshold. The predetermined differential pressure threshold may be, for example, a fraction of the difference between the differential pressure setpoint and the current differential pressure. According to some embodiments, the differential pressure threshold may be 25% of the difference between the differential pressure setpoint and the current differential pressure. If the current differential pressure reading has not yet reached the predetermined differential pressure threshold, then the process returns to block 812. Otherwise, if the current differential pressure reading has reached the predetermined differential pressure threshold, then, at block 816, toolface controller 212 determines that a touchdown condition is met, and that drill bit 120 has touched bottom.

Figure 11:
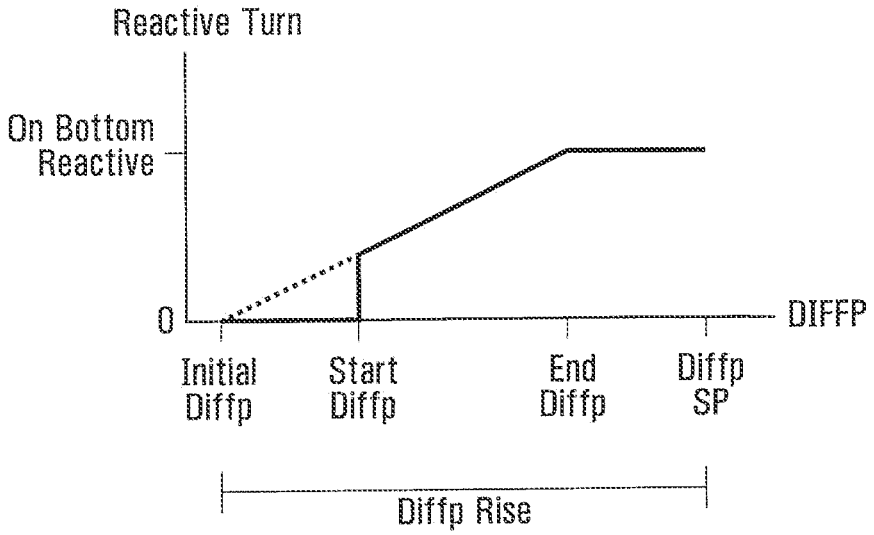
FIG. 11 is a plot of on-bottom reactive rotation being introduced as a function of differential pressure increasing toward a differential pressure setpoint, according to embodiments of the disclosure.

After drill bit 120 is determined to have touched bottom, then, at block 818, toolface controller 212 introduces a second amount (i.e. an on-bottom amount) of reactive rotation into drill string 118, by further adjusting the top drive position setpoint. In particular, as differential pressure increases toward the differential pressure setpoint, the top drive position setpoint is further adjusted in a constant direction in order to further rotate drill string 118. The total amount of on-bottom rotation that drill string 118 undergoes depends on the fraction of the total required reactive rotation (as determined at block 804) that the operator has introduced before drill bit 120 is determined to have touched bottom. FIG. 11 shows an example of on-bottom reactive rotation being introduced proportionally to differential pressure. Generally, the proportion of off-bottom reactive rotation to on-bottom reactive rotation is variable and may be based for example on user-preference and hole depth. Generally, for deeper holes, the proportion of off-bottom reactive rotation to on-bottom reactive rotation increases, as it takes longer for rotation introduced at surface to propagate downhole.

At block 820, toolface controller 212 determines whether the current differential pressure has reached the differential pressure setpoint. Toolface controller 212 ensures that all of the on-bottom reactive rotation is introduced to drill string 118 by the time the differential pressure has reached the differential pressure setpoint. If the current differential pressure has not yet reached the differential pressure setpoint, then the process returns to block 818. In response to determining that the current differential pressure has reached the differential pressure setpoint, then, at block 822, toolface controller 212 increases the differential pressure setpoint such that it corresponds to a reactive pressure value. The reactive pressure value is entered by the user as part of the above pipe twist calculation. At block 822, the differential pressure setpoint, which had previously been set below the reactive pressure value, is made equal to the reactive pressure value. If the differential pressure setpoint is the same as the reactive pressure, this increase is nil. Setting the differential pressure setpoint equal to the reactive pressure value sets the differential pressure setpoint at a known, desired operating value. In order to compensate for this further increase in the differential pressure setpoint, at block 824, toolface controller 212 further adjusts the top drive position setpoint to further rotate drill string 118.

The process then proceeds to block 826 where control of the toolface proceeds with the on-bottom toolface control described above in connection with FIG. 7.

Various parameters may be adjusted in the method described above in connection with FIG. 8. For example, one or more of the following parameters may be adjusted:

- the proportions of the total required reactive rotation that are introduced before and after the differential pressure has reached the differential pressure threshold (indicative of the touchdown condition having been met);
- the distance separating drill bit 120 and the bottom of the wellbore before off-bottom reactive rotation begins to be introduced;
- the distance separating drill bit 120 and the bottom of the wellbore before off-bottom reactive rotation stops being introduced;
- the fraction of the differential pressure rise toward the differential pressure setpoint before on-bottom reactive rotation begins to be introduced; and
- the difference between the differential pressure and the differential pressure setpoint before on-bottom reactive rotation stops being introduced.

Furthermore, according to some embodiments, toolface controller 212 may furthermore monitor a toolface error adjustment value of the form TF_err_adj=TF_err+expected_future_TFDelta. As differential pressure rises, the value of expected_future_TFDelta (the expected future change in toolface in response to the change in differential pressure) will change. Thus, if the toolface is expected to change in a direction that is desired (i.e. that will reduce the toolface error), then the toolface controller may avoid adjusting the toolface setpoint and/or the top drive position setpoint in anticipation of the toolface error reducing as differential pressure increases. Thus, active steering of the toolface may be avoided in favour of the toolface adjusting naturally as a result of the increase in differential pressure. Likewise, if the toolface is expected to change in a direction that is not desired (i.e. that will increase the toolface error), then the toolface controller may provide more active steering by further adjusting the toolface setpoint and/or the top drive position setpoint in anticipation of the toolface error increasing.

The word "a" or "an" when used in conjunction with the term "comprising" or "including" in the claims and/or the specification may mean "one", but it is also consistent with the meaning of "one or more", "at least one", and "one or more than one" unless the content clearly dictates otherwise. Similarly, the word "another" may mean at least a second or more unless the content clearly dictates otherwise.

The terms "coupled", "coupling" or "connected" as used herein can have several different meanings depending on the context in which these terms are used. For example, the terms coupled, coupling, or connected can have a mechanical or electrical connotation. For example, as used herein, the terms coupled, coupling, or connected can indicate that two elements or devices are directly connected to one another or connected to one another through one or more intermediate elements or devices via an electrical element, electrical signal or a mechanical element depending on the particular context. The term "and/or" herein when used in association with a list of items means any one or more of the items comprising that list.

As used herein, a reference to "about" or "approximately" a number or to being "substantially" equal to a number means being within +/−10% of that number.

While the disclosure has been described in connection with specific embodiments, it is to be understood that the disclosure is not limited to these embodiments, and that alterations, modifications, and variations of these embodiments may be carried out by the skilled person without departing from the scope of the disclosure.

It is furthermore contemplated that any part of any aspect or embodiment discussed in this specification can be implemented or combined with any part of any other aspect or embodiment discussed in this specification.

What is claimed is:

1. A method of controlling a toolface of a downhole tool, comprising:

determining the toolface of the downhole tool;

determining a toolface setpoint;

determining, based on the toolface and the toolface setpoint, a toolface error;

selecting, based on the toolface error, one or more drilling parameter setpoints from among multiple drilling parameter setpoints;

adjusting the selected one or more drilling parameter setpoints; and adjusting the toolface of the downhole tool, via one or more drilling controllers, based on the adjusted one or more drilling parameter setpoints input to the one or more drilling controllers, wherein the toolface error is indicative of at least a direction of a difference between the toolface of the downhole tool and the toolface setpoint, and selecting, based on the toolface error, one or more first drilling parameter setpoints from among the multiple drilling parameter setpoints or one or more second drilling parameter setpoints from among the multiple drilling parameter setpoints, wherein the one or more first drilling parameter setpoints are different setpoints than the one or more second drilling parameter setpoints, comprising:

selecting the one or more first drilling parameter setpoints in response to the toolface error indicating that the toolface setpoint is located in a counter-clockwise direction relative to the toolface of the downhole tool; and selecting the one or more second drilling parameter setpoints in response to the toolface error indicating that the toolface setpoint is located in a clockwise direction relative to the toolface of the downhole tool.

2. The method of claim 1, wherein the one or more drilling parameter setpoints comprise one or more of: a weight-on-bit (WOB) setpoint; a differential pressure setpoint; a rate of penetration (ROP) setpoint; and a rotary drive unit position setpoint.

3. The method of claim 2, wherein:

the one or more drilling controllers comprise one or more of an automated drilling unit and a rotary drive unit controller; and inputting the adjusted one or more drilling parameter setpoints to the one or more drilling controllers comprises:

inputting the adjusted one or more drilling parameter setpoints to the automated drilling unit if the adjusted one or more drilling parameter setpoints comprise one or more of a WOB setpoint, an ROP setpoint, and a differential pressure setpoint; and inputting the adjusted one or more drilling parameter setpoints to the rotary drive unit controller if the adjusted one or more drilling parameter setpoints comprise a rotary drive unit position setpoint.

4. The method of claim 1, wherein:

if the toolface error is indicative that the toolface setpoint is located in the counter-clockwise direction relative to the toolface of the downhole tool, the one or more first drilling parameter setpoints include one or more drilling parameter setpoints selected from: a WOB setpoint; an ROP setpoint; and a differential pressure setpoint; and if the toolface error is indicative that the toolface setpoint is located in the clockwise direction relative to the toolface of the downhole tool, the one or more second drilling parameter setpoints include a rotary drive unit position setpoint.

5. The method of claim 1, wherein adjusting the selected one or more drilling parameter setpoints comprises adjusting the selected one or more drilling parameter setpoints with one or any combination of: a proportional controller; an integral controller; and a derivative controller.

6. The method of claim 1, further comprising:

determining a difference between a differential pressure and a differential pressure setpoint; and in response thereto, adjusting a rotary drive unit position setpoint based on the determined difference.

7. The method of claim 1, further comprising:

determining a rate of change of a differential pressure; and in response thereto, adjusting a rotary drive unit position setpoint based on the determined rate of change.

8. A system for controlling a toolface of a downhole tool, the system comprising:

a drill string comprising a downhole tool at a downhole end thereof;

a drill bit connected to the downhole tool; and a toolface controller for controlling the toolface of the downhole tool, the toolface controller comprising computer-readable memory and one or more processors, wherein the compute-readable memory comprises computer program code configured, when executed by the one or more processors, to cause the one or more processors to perform a method comprising:

determining the toolface of the downhole tool;

determining a toolface setpoint;

determining, based on the toolface and the toolface setpoint, a toolface error;

selecting, based on the toolface error, one or more drilling parameter setpoints from among multiple drilling parameter setpoints;

adjusting the selected one or more drilling parameter setpoints; and adjusting the toolface of the downhole tool, via one or more drilling controllers, based on the adjusted one or more drilling parameter setpoints input to the one or more drilling controllers, wherein the toolface error is indicative of at least a direction of a difference between the toolface and the toolface setpoint, and selecting, based on the toolface error, one or more first drilling parameter setpoints from among the multiple drilling parameter setpoints or one or more second drilling parameter setpoints from among the multiple drilling parameter setpoints, wherein the one or more first drilling parameter setpoints are different setpoints than the one or more second drilling parameter setpoints, comprising:

selecting the one or more first drilling parameter setpoints in response to the toolface error indicating that the toolface setpoint is located in a counter-clockwise direction relative to the toolface of the downhole tool; and selecting the one or more second drilling parameter setpoints in response to the toolface error indicating that the toolface setpoint is located in a clockwise direction relative to the toolface of the downhole tool.

9. The system of claim 8, wherein:

if the toolface error is indicative that the toolface setpoint is located in the counter-clockwise direction relative to the toolface of the downhole tool, the one or more first drilling parameter setpoints include one or more drilling parameter setpoints selected from: a WOB setpoint; an ROP setpoint; and a differential pressure setpoint; and if the toolface error is indicative that the toolface setpoint is located in the clockwise direction relative to the toolface of the downhole tool, the one or more second drilling parameter setpoints include a rotary drive unit position setpoint.

10. The system of claim 8, wherein the method further comprises:

determining a difference between a differential pressure and a differential pressure setpoint; and in response thereto, adjusting a rotary drive unit position setpoint based on the determined difference.

11. The system of claim 8, wherein the method further comprises:

determining a rate of change of a differential pressure; and in response thereto, adjusting a rotary drive unit position setpoint based on the determined rate of change.

12. A computer-readable medium having stored thereon computer program code configured, when executed by one or more processors, to cause the one or more processors to perform a method comprising:

determining a toolface of a downhole tool;

determining a toolface setpoint;

determining, based on the toolface and the toolface setpoint, a toolface error;

selecting, based on the toolface error, one or more drilling parameter setpoints from among multiple drilling parameter setpoints;

adjusting the selected one or more drilling parameter setpoints; and adjusting the toolface of the downhole tool, via one or more drilling controllers, based on the adjusted one or more drilling parameter setpoints input to the one or more drilling controllers, wherein the toolface error is indicative of at least a direction of a difference between the toolface and the toolface setpoint, and selecting, based on the toolface error, one or more first drilling parameter setpoints from among the multiple drilling parameter setpoints or one or more second drilling parameter setpoints from among the multiple drilling parameter setpoints, wherein the one or more first drilling parameter setpoints are different setpoints than the one or more second drilling parameter setpoints, comprising:

selecting the one or more first drilling parameter setpoints in response to the toolface error indicating that the toolface setpoint is located in a counter-clockwise direction relative to the toolface of the downhole tool; and selecting the one or more second drilling parameter setpoints in response to the toolface error indicating that the toolface setpoint is located in a clockwise direction relative to the toolface of the downhole tool.

13. The computer-readable medium of claim 12, wherein:

if the toolface error is indicative that the toolface setpoint is located in the counter-clockwise direction relative to the toolface of the downhole tool, the one or more first drilling parameter setpoints include one or more drilling parameter setpoints selected from: a WOB setpoint; an ROP setpoint; and a differential pressure setpoint; and if the toolface error is indicative that the toolface setpoint is located in the clockwise direction relative to the toolface of the downhole tool, the one or more second drilling parameter setpoints include a rotary drive unit position setpoint.

14. The computer-readable medium of claim 12, wherein:

the one or more drilling parameter setpoints comprise one or more of: a weight-on-bit (WOB) setpoint; a differential pressure setpoint; a rate of penetration (ROP) setpoint; and a rotary drive unit position setpoint;

the one or more drilling controllers comprise one or more of an automated drilling unit and a rotary drive unit controller; and inputting the adjusted one or more drilling parameter setpoints to the one or more drilling controllers comprises:

inputting the adjusted one or more drilling parameter setpoints to the automated drilling unit if the adjusted one or more drilling parameter setpoints comprise one or more of a WOB setpoint, an ROP setpoint, and a differential pressure setpoint; and inputting the adjusted one or more drilling parameter setpoints to the rotary drive unit controller if the adjusted one or more drilling parameter setpoints comprise a rotary drive unit position setpoint.

* * * * *